US006051278A

United States Patent [19]

Pleschiutschnigg

[11] Patent Number: 6,051,278

[45] Date of Patent: Apr. 18, 2000

[54] METHOD OF PRODUCING COATED METAL SLABS, PARTICULARLY METAL STRIPS, AND COATING PLANT

[75] Inventor: Fritz-Peter Pleschiutschnigg, Duisburg, Germany

[73] Assignee: SMS Schloemann-Siemag Aktiengesellschaft, Düsseldorf, Germany

[21] Appl. No.: 08/934,954

[22] Filed: Sep. 22, 1997

[30] Foreign Application Priority Data

Sep. 23, 1996 [DE] Germany ..... 196 38 905

[51] Int. Cl.[7] ..... B05D 1/18

[52] U.S. Cl. ..... 427/434.7; 427/431; 427/436

[58] Field of Search ..... 427/431, 433, 427/434.2, 434.7, 436, 443.2

[56] References Cited

U.S. PATENT DOCUMENTS

| | | | |
|---|---|---|---|
| 3,470,939 | 10/1969 | Coad | 427/431 |
| 3,483,030 | 12/1969 | Clarke | 427/431 |
| 3,977,842 | 8/1976 | Mayhew | 29/196.5 |
| 3,995,679 | 12/1976 | Brinkman et al. | 164/86 |

FOREIGN PATENT DOCUMENTS

| | | |
|---|---|---|
| 0311602 | 7/1991 | European Pat. Off. . |
| 4426705 | 9/1995 | Germany . |
| 195 09 691 C1 | 5/1996 | Germany . |

*Primary Examiner*—Shrive Beck
*Assistant Examiner*—Michael Barr
*Attorney, Agent, or Firm*—Friedrich Kueffner

[57] ABSTRACT

A method and apparatus for producing metal slabs in which especially a metal strip of steel is conducted through a bottom entry device of a vessel which is filled with molten metal, particularly steel, and, after the molten metal has crystallized onto the metal slab, the coated metal slab, particularly the coated metal strip, is pulled off above the vessel, wherein the crystallization carrier is conducted though the bottom entry device of the vessel which provides a clear opening width between the core strip and the entry device. Controlled cooling is carried out in the bottom area of the vessel containing the molten metal. The temperature of the molten metal at the nozzle exit of the bottom entry device is adjusted to be greater than the liquidus temperature of the molten metal. A meniscus in the pure melt phase is formed at the nozzle exit at the bottom entry device. A distance exists between the meniscus of the molten metal at the nozzle exit and the begin of the solidification. The heat removal in the area of the bottom entry device is controlled in dependence on the strip speed, bath temperature and gap width in such a way that the meniscus is formed freely and stationary at the nozzle exit.

4 Claims, 3 Drawing Sheets

METHOD OF PRODUCING COATED METAL SLABS, PARTICULARLY METAL STRIPS, AND COATING PLANT

BACKGROUND OF THE INVENTION

1. Field of the Invention

The present invention relates to a method of producing metal slabs in which especially a metal strip of steel is conducted through a bottom entry device of a vessel which is filled with melted metal, particularly steel, and, after the molten steel has crystallized onto the metal slab, the coated metal slab, particularly the coated metal strip, is pulled off above the vessel, wherein the crystallization carrier, i.e., the core strip, is conducted though the bottom entry device of the vessel which provides a clear opening width between the core strip and the entry device. The present invention also relates to an apparatus for carrying out the method.

2. Description of the Related Art

The method and apparatus described above are used predominantly for coating strips, but also for coating sectional members and wire, preferably of steel. The strip, for example, of carbon steel, is conducted through the bottom of a vessel filled with molten steel having the same quality as the strip or a different steel quality, for example, stainless steel, and is for a certain period of time brought into contact with the molten steel whose temperature is controlled in order to coat the strip.

A method and apparatus of this type are the method and device for producing thin metal slabs in accordance with EP 0 311 602 B1. In this method, the bottom of the crystallizer (vessel with molten metal) is mechanically closed relative to the strip traveling therethrough. This mechanical contact can be achieved by means of a body of solid material, such as, a refractory stone, or also of steel, in a sliding or rolling manner.

DE 44 26 705 C1 discloses an inversion casting device with crystallizer. In this case, an uncooled purified metal strip having a low heat content is removed from a metal roll and is guided through molten metal contained in the crystallizer. When the metal strip makes contact with the molten metal, the molten metal crystallizes onto the relatively cool metal section. The thickness of the crystallization depends on the duration of the contact time as well as the temperatures of the metal section and of the molten metal. In this known inversion casting device, a seal horizontally surrounding the crystallizer is provided near the bottom thereof. Nozzles are directed from the seal toward the interior of the crystallizer. The openings of the nozzles are arranged in such a way that the molten metal flowing out of the nozzles impinge at an acute angle onto the carrier strip in the strip travel direction, so that with a relative speed of almost zero the molten metal can crystallize onto the strip. The bottom of the crystallizer is provided with an entry for the metal strip which with a mechanical seal prevents the molten metal from flowing out of the crystallizer.

DE 195 09 691 C1 discloses an inversion casting device with crystallizer having a bottom entry for the metal strip in the crystallizer formed by a slot-shaped duct, wherein there is little contact between the metal strip and the duct, and wherein the molten metal is cooled in the area of the opening of the duct to a temperature in which a two-phase area is present whose crystal component is between 50 and 90%, wherein the metal strip comes into contact in the area of the opening of the duct with this cool quantity of molten metal. The two-phase area should have such a high viscosity that it assumes the function of a seal which renews itself and prevents penetration of the molten steel into the gap and the bottom entry.

DE 195 09 681 C1 discloses another inversion casting device with a crystallizer which is filled with molten metal and in which the carrier strip is preheated to a temperature of about 200° C. before the strip is introduced into the bath of molten metal. Preheating of the carrier strip takes place by means of an indirect heat exchange in the oxygen-free surrounding. For this purpose, the carrier strip is conducted through a relatively long duct arranged perpendicularly in the crystallizer. In the vicinity of the entry point of the carrier strip from the heat transfer duct into the molten metal, a meniscus is formed which is in the two-phase area of the molten metal with an isothermal line which is between the liquidus temperature and the solidus temperature. As is the case in DE 195 09 691 C1, this two-phase area has such a high viscosity that it is supposed to assume the function of a seal which renews itself in order to prevent the molten metal from flowing out of the crystallizer.

Each of the above-described examples of solving the problem of preventing molten metal from flowing out of a crystallizer of an inversion casting device has specific disadvantages.

Thus, in the case of the mechanical seal, it is difficult to realize a uniform movement of the strip to be coated and the wear at the friction-type seal is too high.

On the other hand, in the case of the partial undercooling of the molten metal in the vicinity of the bottom entry for the strip to be coated into the crystallizer, the temperature control is very difficult to carry out, particularly when the temperature difference between liquidus temperature and solidus temperature is a relatively small two-phase area, as it occurs especially in low carbon molten steels (0.005–0.2% C.). In addition, there may be the danger of presolidification and regulus formation at the crystallization carrier.

SUMMARY OF THE INVENTION

Therefore, it is the primary object of the present invention to provide a method and an apparatus of the above-described type which make it possible to cast without problems independently of the steel quality, i.e., independently of the formation of the two-phase area, without friction as well as without very accurate temperature control of ±2° K in the undercooling range of the molten metal.

IN accordance with the present invention, the above object is met by the following method steps. Controlled cooling is carried out in the bottom area of the vessel containing the molten metal, i.e., the crystallizer. The temperature of the molten metal at the nozzle exit of the bottom entry device is adjusted to be greater than the liquidus temperature of the molten metal. A meniscus in the pure melt phase is formed at the nozzle exit at the bottom entry device. A distance exists between the meniscus of the molten metal at the nozzle exit and the begin of the solidification. The heat removal in the area of the bottom entry device is controlled in dependence on the strip speed, bath temperature and gap width in such a way that the meniscus is formed freely and stationary at the nozzle exit.

In accordance with a further development of the present invention, the maximum size of the gap of the nozzle at the nozzle exit between nozzle wall and core strip surface is 5.0 mm, preferably 0.2 to 3.0 mm. This gap width prevents a mechanical contact between the crystallization carrier and the bottom entry nozzle, and the molten metal is prevented from flowing out through the gap of the bottom entry; in addition, an undesired presolidification which would lead to a non-uniform crystallization surface of the coated product is prevented. This positive and unexpected behavior characterizes the present invention which has, among others the following features:

- a gap width of 0.2–3 mm between the steel strip and the bottom entry nozzle in interaction with the surface tension of the molten steel;
- specific cooling in the bottom area of the vessel containing the molten steel, i.e., the crystallizer, by a direct or indirect cooling by means of gas or liquid;
- a temperature of the molten steel at the exit of the nozzle which is greater than the liquidus temperature.

Moreover, in the case of different strip widths, the positions of the nozzle forming elements can be moved and positioned in an optimum manner in the area of the strip edges by displacement between the long side elements of the nozzle corresponding to the strip width while taking into consideration the gaps in the strip edge area. This can be carried out either prior to the beginning of a casting sequence or also during the casting process.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
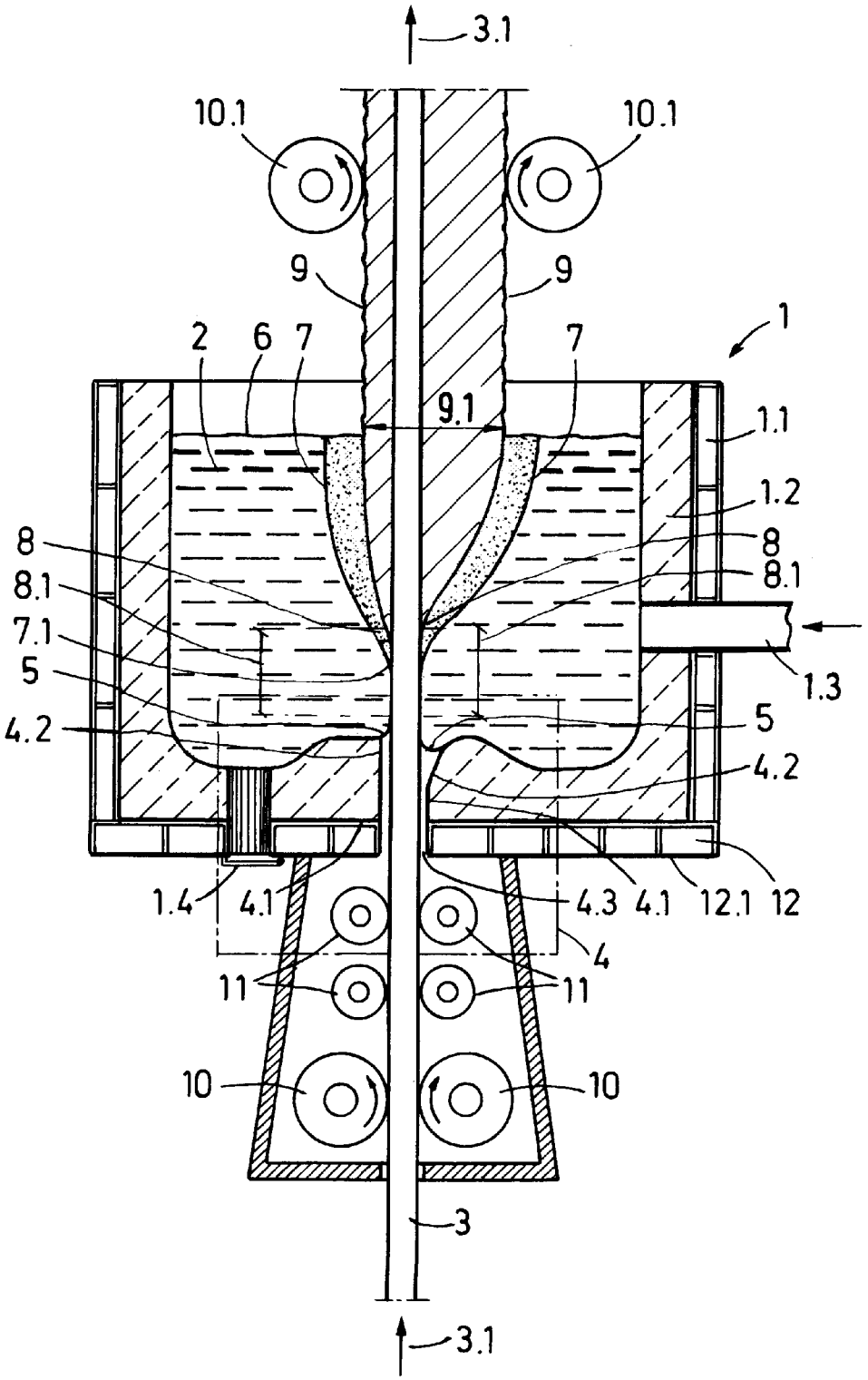
FIG. 1 is a sectional view showing a strip coating plant with bottom entry area.

FIG. 1 of the drawing is a schematic sectional view of an entire strip coating plant. The crystallizer 1 is filled with melt or molten metal 2. The crystallizer 1 is composed essentially of a steel construction 1.1, a refractory lining 1.2, a steel inlet 1.3 and an emergency outlet 1.4. The crystallization carrier, i.e., the core strip 3, is received by the crystallizer through the bottom entry device 4 which is provided with a nozzle 4.1. The molten metal 2 which in the area of the opening of the nozzle, i.e., nozzle outlet 4.2, must have a temperature of greater than liquidus temperature, forms a meniscus 5 at the gap between the core strip 3 and the nozzle outlet 4.2 which prevents the molten metal from flowing out. This formation of the meniscus 5 can only be effected without problems if the temperature of the molten metal is above liquidus temperature, i.e., the melt is present in a purely liquid phase and no presolidifications have occured. This phase in the overheated range (T-actual>T-li) extends between the bath level 6, the T-li isothermal line 7 and the refractory lining 1.2.

The molten metal should have an average temperature of about liquidus temperature +10° K. The pattern of the T-li isothermal line 7 is to be adjusted in such a way that the isothermal line reaches the core strip 3 above the meniscus 5 in point 7.1. When the temperature control is carried out in this way, the solidification begins above the nozzle outlet 4.2, i.e., above the meniscus 5 or above the isothermal line 7 and the point 7.1, i.e., in the point 8 which has a substantial distance 8.1 from the meniscus 5. These thermal conditions make it possible to produce a problem-free uniform coating profile 9 on the core strip 3 even if the temperature of the bath of molten metal varies and, thus, the distance 8.1 varies.

The steel strip 3 is driven vertically through the molten metal with an upwardly directed direction of movement 3.1 by means of driven rollers 10 and a roller guide means 11 which are located in an inert and temperature controlled space. In the bottom entry area 4 which is equipped with the nozzle, the heat transfer into the bottom plate 12 of the crystallizer 1 must be controlled in such a way that no solidification occurs in the area of the meniscus 5 at the nozzle exit 4.2, i.e., a temperature of the molten metal must prevail which is greater than liquidus temperature and does not drop below liquidus temperature during the casting period.

Figure 2:
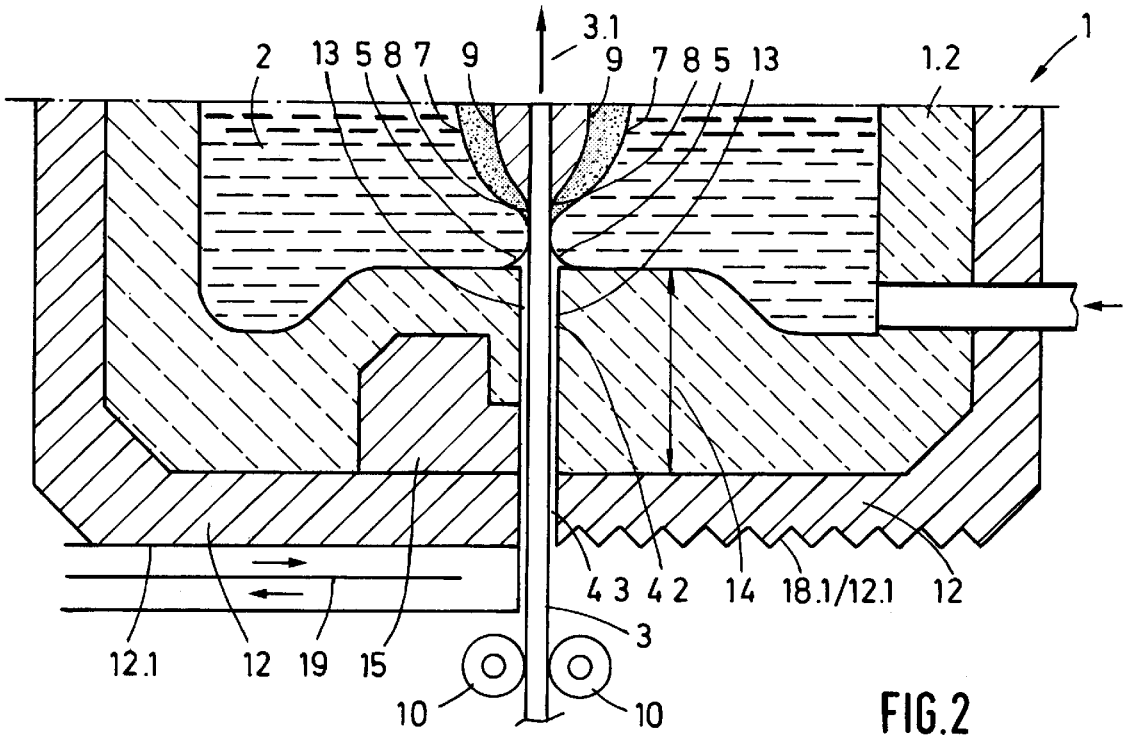
FIGS. 2 and 3 are partial sectional views, on a larger scale, of different embodiments of the bottom entry area of the plant of FIG. 1.
Figure 3:
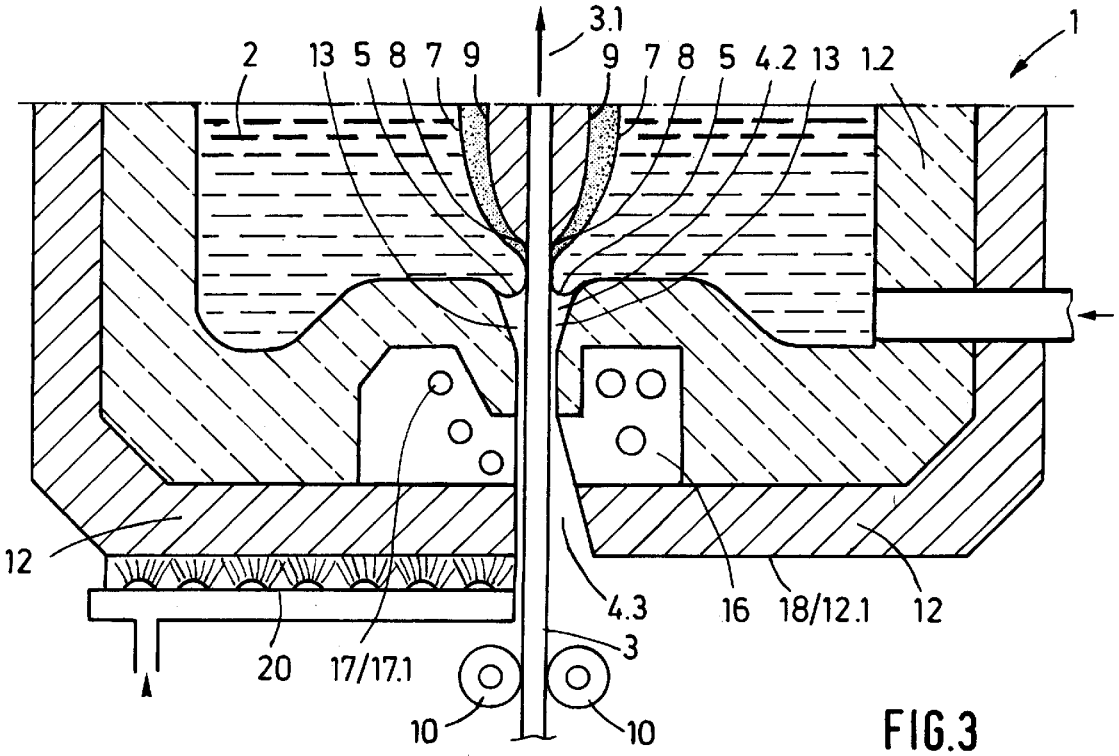

This condition can be met with relatively simple means, for example, the alternative or also combined use of features as they are illustrated in FIGS. 2 and 3 and described in the following.

FIGS. 2 and 3 show the crystallizer 1 with possible embodiments of the bottom entry device 4 for the core strip 3. For achieving a free formation of the meniscus 5 at the nozzle outlet 4.2, different devices can be used alternatively or in combination in the bottom. It is required that the temperature of the molten metal at the meniscus of T-actual>T-liquidus in order to ensure a single-phase stage of the molten metal. The distance or gap 13 between crystallization carrier, i.e., the core strip 3 and the nozzle outlet 4.2 should be between 0.2 and 3 mm in order to prevent jamming of the core strip 3 in the nozzle 4.1, on one hand, and to prevent the molten metal 2 from flowing out of the crystallizer 1, on the other hand.

The bottom entry area 4 is constructed between the molten metal 2 and the bottom plate 12 for effecting a controlled heat transfer as follows:

- a pure refractory lining 1.2 having a certain thickness 14, as shown in FIG. 2, and a specific thermal conductivity;
- a metal block 15, shown in FIG. 2, for a better transfer of the heat into the bottom plate 12, while taking into consideration the total thermal conductivity of all material phases between the molten metal 2 and the outer surface 12.1 of the bottom plate 12;
- a metal block 16, shown in FIG. 3, with internal cooling by gas or liquid;
- an electromagnetic device, shown in FIG. 3, for closing the molten metal vessel, a metal pump 17 and/or inductive 17.1 for preheating the core strip.

The gap 13 at the nozzle outlet 4.2 as well as the nozzle inlet 4.3 may be parallel, as shown in FIG. 2 or also conical, as shown in FIG. 3.

The conical configuration results in a problem-free travel of the core strip 3 and a free formation of the meniscus 5.

The thermal flow entering the bottom plate 12 can be removed by means of various controlled means either alternatively or in combination:

- a planar bottom plate 18, as shown in FIG. 3, or a bottom plate 18.1 with increased surface area, as shown in FIG. 2, with contact to the free atmosphere;
- a planar bottom plate with indirect open or closed cooling by means of gas or liquid 19, as shown in FIG. 2;
- an open indirect cooling 20, as shown in FIG. 3, by means of nozzles for gas or liquid.

For ensuring a problem-free travel of the strip, the embodiments of the bottom entry device proposed above can be selected alternatively or in combination for an optimized adjustment of the molten metal temperature at the nozzle outlet 4.2 and the formation of the meniscus 5 at the nozzle outlet 4.2.

Figure 4:
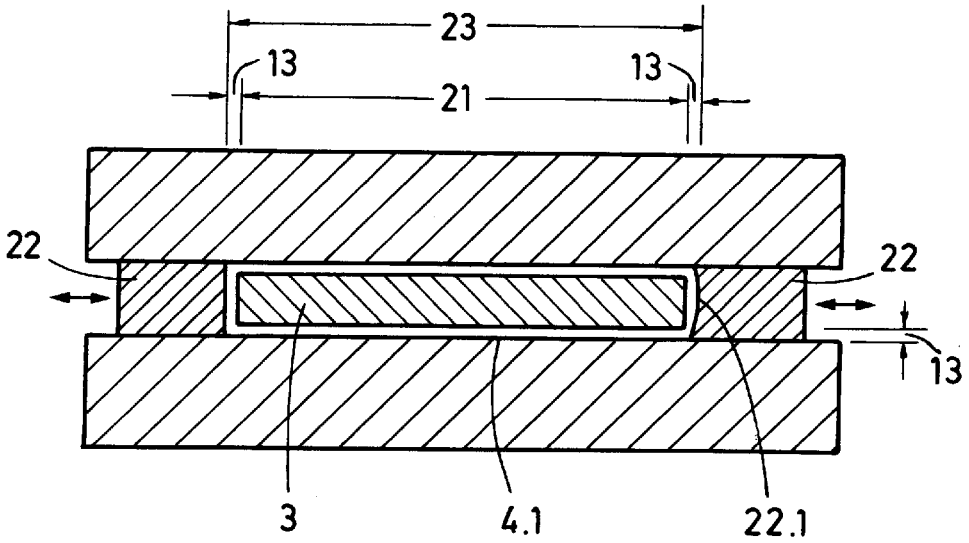
FIG. 4 is a sectional view of an adjustable device in the bottom entry area for different strip widths and an optimum gap spacing in width direction.

In addition, as shown in FIG. 4, in the case of a strip, the nozzle width 21 can be freely preselected by using adjustable width defining members 22. The gap 13 between nozzle 4.1 and core strip 3 can be adjusted in an optimum manner by adjusting the width 23 taking into account the width 21 of the strip. Moreover, the apparatus makes it possible to change the strip width during a casting sequence.

The invention is not limited by the embodiments described above which are presented as examples only but can be modified in various ways within the scope of protection defined by the appended patent claims.

I claim:

1. A method of producing coated metal slabs, wherein the slab is conducted into a vessel filled with molten metal through a bottom entry device of the vessel, the bottom entry device having a gap with a gap width, wherein the slab travels through the gap, wherein, after molten metal has crystallized onto the metal slab, the coated slab is pulled off above the vessel, the method comprising carrying out a controlled cooling in a bottom area of the vessel, adjusting a temperature of the molten metal at a nozzle outlet of the bottom entry device which is greater than the liquidus temperature of the molten metal, forming a meniscus in a pure melted phase at the nozzle outlet of the bottom entry device, sealing the nozzle outlet exclusively with the meniscus of the molten metal, forming a distance between the meniscus of the molten metal at the nozzle outlet and a solidification beginning, and controlling a heat removal in the area of the bottom entry device in dependence on a slab speed, molten metal bath temperature and gap width in such a way that the meniscus is formed freely and stationarily at the nozzle outlet.

2. The method according to claim 1, comprising determining a final thickness of the coating of the slab by selecting the bath temperature above the liquidus temperature with a constant predetermined dwell time of the slab in the molten metal.

3. The method according to claim 1, comprising determining the final thickness of the coated metal slab by selecting a thickness of the slab entering the molten metal, with a constant predetermined dwell time of the slab in the molten metal.

4. The method according to claim 1, comprising cooling the bottom area of the vessel by means of gas or liquid.

* * * * *